US007405708B2

(12) United States Patent
Ahn et al.

(10) Patent No.: US 7,405,708 B2
(45) Date of Patent: Jul. 29, 2008

(54) LOW PROFILED ANTENNA

(75) Inventors: Jiho Ahn, 105-601, Samhwan Apt. 897-2, Shingil 7-Dong, Yongdeungpo-Gu, Seoul (KR); Sergey Bankov, Moscow (RU); Alexander Davydov, Kanischevo (RU)

(73) Assignee: Jiho Ahn, Yongdeungpo-Gu, Seoul (KR)

( * ) Notice: Subject to any disclaimer, the term of this patent is extended or adjusted under 35 U.S.C. 154(b) by 0 days.

(21) Appl. No.: 11/598,846

(22) Filed: Nov. 14, 2006

(65) Prior Publication Data

US 2007/0200781 A1 Aug. 30, 2007

Related U.S. Application Data

(63) Continuation-in-part of application No. 11/287,979, filed on Nov. 28, 2005.

(30) Foreign Application Priority Data

May 31, 2005 (RU) ..... 2005116584
Oct. 31, 2006 (KR) ..... 10-2006-0106048

(51) Int. Cl.
*H01Q 19/14* (2006.01)

(52) U.S. Cl. ..... 343/781 CA; 343/781 R

(58) Field of Classification Search ..... 343/781 CA, 343/781 P, 781 R, 779
See application file for complete search history.

(56) References Cited

U.S. PATENT DOCUMENTS 588,863 A 8/1897 Harry
1,804,673 A 5/1931 Chace
3,296,685 A * 1/1967 Suliteanu ..... 29/600
5,182,569 A * 1/1993 Bui-Hai ..... 343/781 CA
5,243,357 A 9/1993 Koike
5,859,619 A * 1/1999 Wu et al. ..... 343/781 CA
6,480,164 B2 * 11/2002 Posner et al. ..... 343/772
6,603,437 B2 8/2003 Chang
7,075,492 B1 * 7/2006 Chen et al. ..... 343/755

FOREIGN PATENT DOCUMENTS

GB 973583 4/1963
JP 61-245605 10/1986

* cited by examiner

*Primary Examiner*—HoangAnh T Le
(74) *Attorney, Agent, or Firm*—John K. Park; Park Law Firm

(57) ABSTRACT

An antenna comprises: a main reflector being a body of revolution of arbitrary curve which axis diverges from axis of the revolution; a sub-reflector being a body of the revolution of arbitrary curve along the axis of revolution, having a circle and a vertex pointing to the main reflector and being placed between the circle and the main reflector; a radiator being located along the axis of revolution and being placed between the main reflector and the sub-reflector; and wherein the main reflector and the sub-reflector are:

$$z_m(r, D) = \sum_{n=0}^{4}\sum_{m=0}^{6} qm_{n,m} D^{m-n+1} r^n,$$

$$z_s(r, D) = \sum_{n=0}^{4}\sum_{m=0}^{6} qs_{n,m} D^{m-n+1} r^n,$$

z, r are coordinates of the main reflector and the sub-reflector measured in millimeters,
Index m corresponds to the main reflector, index s to the sub-reflector
D is the main reflector diameter measured in millimeters.

14 Claims, 6 Drawing Sheets

$1\text{-}\frac{D}{\lambda}=6.2,\qquad 2\text{-}\frac{D}{\lambda}=9.44,\qquad 3\text{-}\frac{D}{\lambda}=14.4$

LOW PROFILED ANTENNA

REFERENCE TO RELATED APPLICATIONS

This application is a continuation-in-part of, and claims priority to U.S. patent application Ser. No. 11/287,979 filed Nov. 28, 2005, which is hereby incorporated by reference.

CLAIMING FOREIGN PRIORITY

The applicant claims and requests a foreign priority, through the Paris Convention for the Protection of Industrial Property, based on patent applications filed in the Republic of Korea (South Korea) with the filing date of Oct. 31, 2006 with the patent application number 10-2006-0106048 and patent application in Russia with the filing date of May 31, 2005 with the patent application number 2005116584 by the applicant, the contents of which are incorporated by reference into this disclosure as if fully set forth herein.

FIELD OF THE INVENTION

The invention refers generally to an antenna, and more particularly, to an antenna including a main reflector and a sub-reflector which may be used as antennas for satellite TV broadcasting etc.

BACKGROUND OF THE INVENTION

Parabolic reflector antennas are widely used as satellite television antenna due to a number of factors like the following:

low cost;

wide frequency range;

simplicity of working with waves of different polarization;

reasonable high aperture efficiency (AE)—usually 60-65%.

There is a known device such as axially symmetric dual reflector antenna with offset from symmetry axis main reflector focus (Patent Great Britain No. 973583, HO1D, published 1962). In this design, a parabolic shaped main reflector and an arbitrary shaped sub-reflector are used. As a particular case, an elliptically shaped sub-reflector is offered. The arrangement of the sub-reflector focus, the main reflector focus and feed phase center is common, i.e. first focus of the ellipse coincides with phase center and second focus of the ellipse coincides with focus of the parabola.

There is a known device as an antenna where focuses of a parabolic main reflector and a sub-reflector are displaced so that the sub-reflector vertex and above mentioned focuses are disposed on one straight line and the ratio of focal diameters of the sub-reflector and the main reflector is chosen in range of 1.03-1.07 (Patent USSR No. 588863, H01Q15/00, published in 1972).

In this design, a problem for antenna gain increasing is solved and the antenna itself suffers from large lateral size and especially large longitudinal size.

In another known patent (Patent USSR No. 1804673, H01Q19/18, published 1993), it is mentioned that radiating horn radiates not perfectly spherical wave but a wave with diffused center. Owing to this fact included in the above patent, phase error is corrected by the shape of a sub-reflector further comprising one focus coinciding with a parabolic main reflector focus.

Typically, parabolic antennas occupy a large volume. Most advantages of parabolic antennas appear when the ratio of antenna focal length F and antenna diameter D is sufficiently large. As antenna feed must be certainly placed in the reflector focus, it necessarily leads to the increase of the antenna system size.

Large system size leads to the following disadvantages:

A great number of such antennas disfigures architectural image of buildings. In particular, many countries prohibit installation of parabolic antennas or walls and roofs for this reason.

Parabolic antennas are impossible or very difficult to use in mobile devices, especially when required to provide signal reception during the movement of a car, train, ship, etc.

Due to the above mentioned circumstances, an actual problem arises—to develop for satellite TV or any other flat antennas which occupy sufficiently less volume.

The feature of dual reflector antennas with minimal thickness is that their radiator horns and sub-reflectors form an electromagnetic field which differs from geometrical optics field. Therefore, the choice of antenna parameters claimed in the patents mentioned above is not optimal neither is it applicable to the problem at hand. This statement is verified by U.S. Pat. No. 6,603,437 which claims an algorithm for shape choice of a main reflector and a sub-reflector which gives an optimal solution only for the sub-reflectors of diameter not less than five free-space wavelengths.

In case of antennas with minimal thickness and maximal aperture efficiency, the above mentioned condition may not be correct at least for antennas having a main reflector diameter less than 36 wavelengths. It is obvious that usage of big electrical size sub-reflectors will lead to aperture efficiency decrease due to the shadowing of the main reflector by sub-reflector. As an example, therefore, maximal values of aperture efficiency are achieved when sub-reflector diameter is about 2-3 wavelengths. Note that antenna thickness is from 1 to 3.5 wavelength when its main reflector diameter is from 5 to 18 wavelength. At such sizes of radiator horns and sub-reflectors, their focuses are diffused and incident to the main reflector thus wave beam forming can not be described correctly in terms of geometrical optics.

There is a known technical solution in which suggests to connect dual polarized antennas by means of dual mode waveguides. For instance, circular or square (U.S. Pat. No. 5,243,357). The width of dual mode waveguide must not be less than 0.5 wavelength. Single mode waveguide may have thickness much smaller than 0.5 wavelength. Real lateral dimension size of a dual mode waveguide is about 0.7 wavelengths. Therefore, Connection of some units of antennas into one antenna array based on dual mode waveguides can not be thinner than above mentioned 0.7 wavelengths. Waveguide bends which necessarily appear in such connections, should be added to this value. Thus, the real thickness of such connection will not be less than 1.5 wavelength. Furthermore, dual mode waveguide components produce hard requirements to waveguide elements manufacturing accuracy because technological errors may lead to differently polarized waves interconnection which will downgrade the device parameters.

As an example, an antenna-feeder device comprises four dual reflector antennas positioned in one plane, a main reflector of each antenna is formed by parabolic generatrix rotation around an axis, where focus of parabolic generatrix is situated outward from rotation axis, and a sub-reflector is formed by elliptic generatrix rotation around the same axis with forming of circle and vertex faced to the main reflector and situated between the circle and the main reflector, where one of the elliptic generated focuses is situated on the rotation axis, and radiators for each antenna are situated on the rotation axis in the main reflector base between the parabolic surface main reflector and the sub-reflector, feeding device is made on the base of dividers, where each of dividers is made as a junction of single mode transmission lines and each of dividers is made with equi-phase power division on two equal halves, input of feeding device can be connected with receiving and/or transmitting device, and four outputs of feeding devices are correspondingly connected with antenna radiators (Japanese Patent JP61245605, H 01 Q 21/06, published Oct. 31, 1986.

This device can not provide antenna operation on two orthogonal polarizations, and only single polarization work is provided. The limitations of this technical solution also include large lateral and transversal dimensions.

The present invention provides an antenna-feeder device and antenna with smaller size than current solutions.

Some of the technical advantages that may be achieved by manufacturing an antenna-feeder device and antenna in accordance with preferred embodiments of the present invention are reduction of device/antenna size and thickness, providing possibility of transmitting/receiving signals of both orthogonal polarizations with high isolation—not less than 20 dB, while covering a broad frequency range. By way of example a well designed antenna according to the preferred embodiments may cover the entire satellite TV range of 10.7-12.75 Ghz. Clearly other ranges of frequencies are achievable as will be clear to the skilled in the art.

Yet another desired technical result that may be achieved by the antenna-feeder device and antenna is reducing of longitudinal size with retention of high aperture efficiency and wide frequency range.

In these specifications, the term "circle" denotes a circle, formed by the intersection of a body of rotation formed when a parabolic or elliptic shape is rotated about an axis of rotation, and a plane perpendicular to the axis of rotation. It is notable that while the description and the claims utilize to the geometrical form, engineering considerations may dictate deviation from this ideal shape, yet allow a functionally equivalent shape to perform in accordance with the mode of operation and the functions described herein, and thus the invention and the claims should be construed to extend to such embodiments.

SUMMARY OF THE INVENTION

According to one aspect of the present invention, there is provided an antenna-feeder device comprising: four dual reflector antennas situated in one plane, each of said dual reflector antenna further comprising a main reflector at least partially conforming a body of revolution of parabolic shape whose parabolic axis diverges from the axis of the revolution (Z Axis, longitudinal symmetrical center of whole antenna), and a sub-reflector at least partially conforming to a body of the revolution of an elliptic shape having a circle and a vertex pointing to the main reflector and being placed between the circle and the main reflector, one focal point of the sub-reflector being placed on the axis of revolution and the other focal point of the sub-reflector being placed away from the axis, the circle of the sub-reflector being placed in the plane of an edge circle formed by the main reflector, and a radiator located along the axis of revolution and between the main reflector and the sub-reflector;

a feeding device on the base of dividers wherein each divider comprises a T-shaped junction of single-mode transmission lines and each divider provides equi-phase power division on two equal halves, one input of the feeding device is connected to a transmitter or a receiver and each of four outputs of the feeding device is connected correspondingly to each radiator of the four antennas, and the input and the four outputs of the feeding device are made in form of dual mode transmission lines, the input is connected with the four output with help of four dividers, central branches of the four dividers are connected to the input while side branches of each of the four dividers are connected to neighboring outputs and four phase shifters with 180 degree phase shift are inserted in the side branches of the dividers connected with the outputs located at the opposite sides of the feeding device Further, additional embodiments and improvements of an antenna-feeder device are envisioned, such as:

placing a common cover situated in one common plane of each main reflector edge circle where each sub-reflector is situated on the common cover;

having an input and four outputs of the feeding device be made of circular waveguide sections;

having an input and four outputs of feeding device be made of square waveguide sections;

having an input connected to four outputs by means of rectangular waveguide sections made in the form of four T-shaped junctions.

For the additional embodiment above, phase shifters can be made by decreasing or increasing of the width of rectangular waveguides width in the side branches of the T-shaped junctions faced to corresponding output or by dielectric plates installed in the side branches of the T-shaped junctions faced to corresponding outputs or by increasing the length of side branches of the T-shaped junctions faced to corresponding outputs.

Furthermore, the input may be connected to the four outputs by coaxial line sections made in the form of four T-shaped junctions.

Furthermore, the input may be connected to the four outputs by strip line sections made in the form of four T-shaped junctions.

In order to provide the last additional embodiment, some modification and/or additions are optional when it is reasonable that:

phase shifters may be embodied in loop-shaped/(bended shaped) printed strip line or lines;

side divider branches may be made of strip lines or lines and a central divider branch may be made in the shape of probe where probe is inserted into the output of a dual mode transmission line and the side divider branches are inserted into corresponding output dual mode transmission lines by probes.

The antenna-feeder device further comprises T-shaped junctions on the base of transmission lines as dividers The antenna-feeder device further comprises the phase shifters realized as additional sections of transmission lines;

According to another aspect of the present invention, there is provided an antenna comprising: a main reflector at least partially conforming to a body of revolution of parabolic shape whose parabolic axis diverges from the axis of the revolution (Z Axis, longitudinal symmetrical center of whole antenna), and a sub-reflector at least partially conforming to a body of the revolution of an elliptic shape, having a circle and a vertex pointing to the main reflector and being placed between the circle and the main reflector, one focal point of the sub-reflector being placed on the axis of revolution and the other focal point of the sub-reflector being placed away from the axis, the circle of the sub-reflector being placed in the plane of an edge circle formed by the main reflector, and a radiator located along the axis of revolution and between the main reflector and the sub-reflector, and wherein the sub-reflector has eccentricity ranging from 0.55 to 0.75.

For additional embodiment above, the ratio of the distance M between the sub-reflector circle and the main reflector apex to the main reflector diameter D ranges 0.15-0.35 (Refer to FIG. 7)

Further, the distance d between two focuses of the sub-reflector may be selected under the following condition:

$$, \frac{d}{\lambda} = \begin{cases} 1.2 - 1.6 \text{ when } \frac{D}{\lambda} \leq 12 \\ 1.8 - 2.1 \text{ when } \frac{D}{\lambda} > 12 \end{cases}$$

λ is a free space wavelength

D is the diameter of the main reflector,

Wherein an angle β between a line connecting the above focuses of the sub-reflector and an axis of the revolution may be selected in the range 45-70 degrees (Refer to FIG. 7).

Also, additional embodiments and improvements of antenna design are envisioned, such as:

having a cover situated near the plane of the edge circle formed by the main reflector, wherein the sub-reflector is fixed on the cover;

having a cover situated on the plane of the edge circle formed by the main reflector, wherein the sub-reflector is fixed on the cover. That is, the main reflector edge circle is located at the same one place with the sub-reflector circle;

The radius $E_r$ of the sub-reflector circle may be chosen by the following condition $$, \frac{E_r}{\lambda} = \begin{cases} 0.5 - 1.2 \text{ when } \frac{D}{\lambda} \leq 12 \\ 1.5 - 1.8 \text{ when } \frac{D}{\lambda} > 12 \end{cases}$$

λ is free space wavelength;

D is the diameter of the main reflector;

The proportion between focal ring radiuses of the sub-reflector elliptical surface second focus and the main reflector parabolic surface focus may be chosen by the following condition $$1.015 \leqq Fe2_r/F_r \leqq 1.6$$

$Fe2_r$ is focal ring radius of the sub-reflector second focus;

$F_r$ is focal ring radius of the main reflector parabolic surface focus;

In the specifications of all the modifications in the present invention, the term "focal ring" denotes a circle formed by each focus such as Fe2, F of FIG. 7 when parabolic or elliptic shape is rotated about an axis of rotation and each focus such as Fe2 and F is rotated.

The radiator may be made as a conical horn.

Further, the proportion between the radius $H_r$ of the radiator conical horn and free space wavelength may be chosen by the following condition $$0.6 < \frac{H_r}{\lambda} < 1.1$$

and a complete flare angle α of the conical horn may be chosen by the following condition $$\alpha = \begin{cases} 25 - 60^0 \text{ when } \frac{D}{\lambda} > 8 \\ 70 - 110^0 \text{ when } \frac{D}{\lambda} < 8 \end{cases}$$

D is the diameter of the main reflector

Further optionally, the main reflector may be a body of revolution of parabolic shape who's axis coincides with the axis of the revolution (Z axis, longitudinal symmetrical center of whole antenna) and the sub-reflector may be a body of revolution of elliptic shape which axis may be located on the axis of the revolution (Z axis, longitudinal symmetrical center of whole antenna) or located proximally thereto According to another aspect of the present invention, there is provided an antenna comprising: a main reflector at least partially conforming to a body of revolution of parabolic shape whose parabolic axis diverges from the axis of the revolution (Z Axis, longitudinal symmetrical center of whole antenna), and a sub-reflector at least partially conforming to a body of the revolution of an elliptic shape, having a circle and a vertex pointing to the main reflector and being placed between the circle and the main reflector, one focal point of the sub-reflector being placed on the axis of revolution and the other focal point of the sub-reflector being placed away from the axis, the circle of the sub-reflector being placed in the plane of an edge circle formed by the main reflector, and a radiator located along the axis of revolution and between the main reflector and the sub-reflector; and wherein the relation between radius of the focal ring of the sub-reflector second focus placed away from the axis and radius of the focal ring of the main reflector may be selected under the following condition:

$$1.015 \leqq Fe2_r/F_r \leqq 1.6$$

where $Fe2_r$ is focal ring radius of the sub-reflector second focus placed away from the axis, $F_r$ is focal ring radius of the main reflector.

For additional embodiment above, the sub-reflector eccentricity may range from 0.55 to 0.75.

Further, the ratio of the distance M between the sub-reflector circle and the main reflector apex to the main reflector diameter D ranges 0.15-0.35(Refer to FIG. 7)

Further, a distance d between two focuses of the sub-reflector is selected under the following condition:

$$, \frac{d}{\lambda} = \begin{cases} 1.2 - 1.6 \text{ when } \frac{D}{\lambda} \leq 12 \\ 1.8 - 2.1 \text{ when } \frac{D}{\lambda} > 12 \end{cases}$$

λ is a free space wavelength

D is a diameter of the main reflector,

Wherein an angle β between a line connecting the above focuses of the sub-reflector and the axis of revolution (Z axis, Symmetrical center of antenna) may be selected in range 45-70 degrees. (Refer to FIG. 7)

Also, additional embodiments of antenna design may be envisioned, such as:

having a cover situated near the plane of the edge circle formed by the main reflector, the cover having the sub-reflector fixed thereon;

having a cover situated on the plane of the edge circle formed by the main reflector, having the sub-reflector fixed on the cover and that is, the main reflector edge circle is located at the same one plane with the sub-reflector circle;

The radius $E_r$ of the sub-reflector circle may be chosen by the following condition $$, \frac{E_r}{\lambda} = \begin{cases} 0.5 - 1.2 \text{ when } \frac{D}{\lambda} \le 12 \\ 1.5 - 1.8 \text{ when } \frac{D}{\lambda} > 12 \end{cases}$$

λ is free space wavelength;

D is the diameter of the main reflector;

The radiator may be made as a conical horn.

For the additional embodiments and improvements, the proportion between the radius $H_r$ of the radiator conical horn and free space wavelength may be chosen by the following condition $$0.6 < \frac{H_r}{\lambda} < 1.1$$

and a complete flare angle α of conical horn may be chosen by the following condition $$\alpha = \begin{cases} 25 - 60^0 \text{ when } \frac{D}{\lambda} > 8 \\ 70 - 110^0 \text{ when } \frac{D}{\lambda} < 8 \end{cases}$$

D is the diameter of the main reflector

Further optionally, the main reflector may be a body of revolution of parabolic shape who's axis coincides with the axis of the revolution (Z axis, longitudinal symmetrical center of whole antenna). And the sub-reflector may be a body of revolution of elliptic shape which axis may be located on the axis of the revolution (Z axis, longitudinal symmetrical center of whole antenna) or located proximally thereto According to another aspect of the present invention, there is provided an antenna comprising: a main reflector at least partially conforming to a body of revolution of an arbitrary curve whose arbitrary curve axis diverges from the axis of the revolution (Z Axis, longitudinal symmetrical center of whole antenna), and a sub-reflector at least partially conforming to a body of the revolution of an arbitrary curve, having a circle and a vertex pointing to the main reflector and being placed between the circle and the main reflector, the circle of the sub-reflector being placed in the plane of an edge circle formed by the main reflector, and a radiator located along the axis of revolution of the main reflector and between the main reflector and the sub-reflector; and wherein the ratio of the distance M-M between the sub-reflector circle A-A and the main reflector 1-1 apex to the main reflector 1-1 diameter D ranges 0.15~0.35 (Refer to FIG. 11)

Further, the main reflector and the sub-reflector may be defined as follows:

$$z_m(r, D) = \sum_{n=0}^{4} \sum_{m=0}^{6} qm_{n,m} D^{m-n+1} r^n,$$

$$z_s(r, D) = \sum_{n=0}^{4} \sum_{m=0}^{6} qs_{n,m} D^{m-n+1} r^n,$$

z, r are coordinates of the main reflector and the sub-reflector measured in millimeters, Index m corresponds to the main reflector and; index s to the sub-reflector D is the main reflector diameter measured in millimeters.

and numbers $qm_{n,m}$ and $qs_{n,m}$ may be selected in the ranges:

$$qm0_{n,m} - \frac{3}{D^{m+1}} \le qm_{n,m} \le qm0_{n,m} + \frac{3}{D^{m+1}},$$

$$qs0_{n,m} - \frac{1.5}{D^{m+1}} 40^n \le qs_{n,m} \le qs0_{n,m} + \frac{1.5}{D^{m+1}} 40^n,$$

where $qs0_{n,m}$, $qm0_{nm}$ are defined in the below tables:

| | m = 0 | 1 | 2 | 3 | 4 | 5 | 6 |
|---|---|---|---|---|---|---|---|
| $qs0_{n,m}$ | | | | | | | |
| n = 0 | 0.40362 | −0.00422 | 1.87E−05 | −4.3E−08 | 5.47E−11 | −3.6E−14 | 9.57E−18 |
| 1 | −7.98145 | 0.098642 | −0.00044 | 1.02E−06 | −1.3E−09 | 8.36E−13 | −2.2E−16 |
| 2 | −325.922 | 3.60874 | −0.01599 | 3.54E−05 | −4.2E−08 | 2.44E−11 | −5.6E−15 |
| 3 | 2687.903 | −27.1192 | 0.101879 | −0.00017 | 1.02E−07 | 2.11E−11 | −3.2E−14 |
| 4 | 4992.915 | −116.572 | 0.882748 | −0.00311 | 5.53E−06 | −4.8E−09 | 1.65E−12 |
| $qm0_{n,m}$ | | | | | | | |
| n = 0 | −1.67048 | 0.017508 | −7.9E−05 | 1.77E−07 | −2.1E−10 | 1.34E−13 | −3.4E−17 |
| 1 | 1.882187 | −0.03057 | 0.000154 | −3.8E−07 | 4.91E−10 | −3.3E−13 | 8.85E−17 |
| 2 | −9.07096 | 0.118857 | −0.00053 | 1.18E−06 | −1.4E−09 | 9.02E−13 | −2.3E−16 |
| 3 | 0 | 0 | 0 | 0 | 0 | 0 | 0 |
| 4 | 0 | 0 | 0 | 0 | 0 | 0 | 0 |

Further, the sub-reflector may be a body of revolution of an elliptical curve and one focal point of the sub-reflector may be placed on the axis of revolution and the other focal point of the sub-reflector may be placed away from the axis and wherein the sub-reflector has an eccentricity ranging from 0.55 to 0.75 and a distance d between the above two focuses of the sub-reflector may be selected under the following condition:

$$, \frac{d}{\lambda} = \begin{cases} 1.2 - 1.6 \text{ when } \frac{D}{\lambda} \leq 12 \\ 1.8 - 2.1 \text{ when } \frac{D}{\lambda} > 12 \end{cases}$$

λ is a free space wavelength

D is the diameter of the main reflector,

Wherein an angle β between a line connecting the above focuses of the sub-reflector and the axis of revolution may be selected in the range 45-70 degrees. (Refer to FIG. 7)

Further, the main reflector may be a body of revolution of a parabolic curve and the sub-reflector may be a body of revolution of an elliptical curve, wherein the relation between the radius of the focal ring of the sub-reflector second focus placed away from the axis and the radius of the focal ring of the main reflector may be selected under the following condition:

$$1.015 \leqq Fe2_r/F_r \leqq 1.6$$

where $Fe2_r$ is focal ring radius of the sub-reflector second focus placed away from the axis, $F_r$ is focal ring radius of the main reflector.

Additional embodiments of antenna design may be envisioned, such as:

having a cover situated near the plane of the edge circle formed by the main reflector, the cover having the sub-reflector fixed thereon;

having a cover situated on the plane of the edge circle formed by the main reflector, the cover having the sub-reflector fixed thereon, that is, the main reflector edge circle is located at the same one plane with the sub-reflector circle;

The radius $E_r$ of the sub-reflector circle may be chosen by the following condition $$, \frac{E_r}{\lambda} = \begin{cases} 0.5 - 1.2 \text{ when } \frac{D}{\lambda} \leq 12 \\ 1.5 - 1.8 \text{ when } \frac{D}{\lambda} > 12 \end{cases}$$

λ is free space wavelength;

D is diameter of the main reflector;

A Radiator may be made as a conical horn.

Further, the proportion between the radius $H_r$ of the radiator conical horn and free space wavelength may be chosen by the following condition $$0.6 < \frac{H_r}{\lambda} < 1.1$$

and a complete flare angle α of conical horn may be chosen by the following condition $$\alpha = \begin{cases} 25 - 60^0 \text{ when } \frac{D}{\lambda} > 8 \\ 70 - 110^0 \text{ when } \frac{D}{\lambda} < 8 \end{cases}$$

D is the diameter of the main reflector

λ is free space wavelength

Further optionally, the main reflector may be a body of revolution of an arbitrary curve who's axis coincides with the axis of the revolution (Z axis, longitudinal symmetrical center of whole antenna). Further, the sub-reflector may be a body of revolution of an arbitrary curve which axis may be located on the axis of the revolution (Z axis, longitudinal symmetrical center of whole antenna) or located proximally thereto It is notable that the mentioned antenna configuration in all the present inventions may be same with the one of axially displaced antenna.

And it is also notable that the term "axis of the revolution" in all these mentioned specifications denotes Z axis in FIGS. 7,9,11 which is a longitudinal symmetrical center of whole antenna including a main reflector and a sub-reflector and a radiator.

BRIEF DESCRIPTION OF THE DRAWINGS

Mentioned advantages and specialties of present invention are illustrated by best versions of it's design with references to figures enclosed.

DETAILED DESCRIPTION

Figure 1:
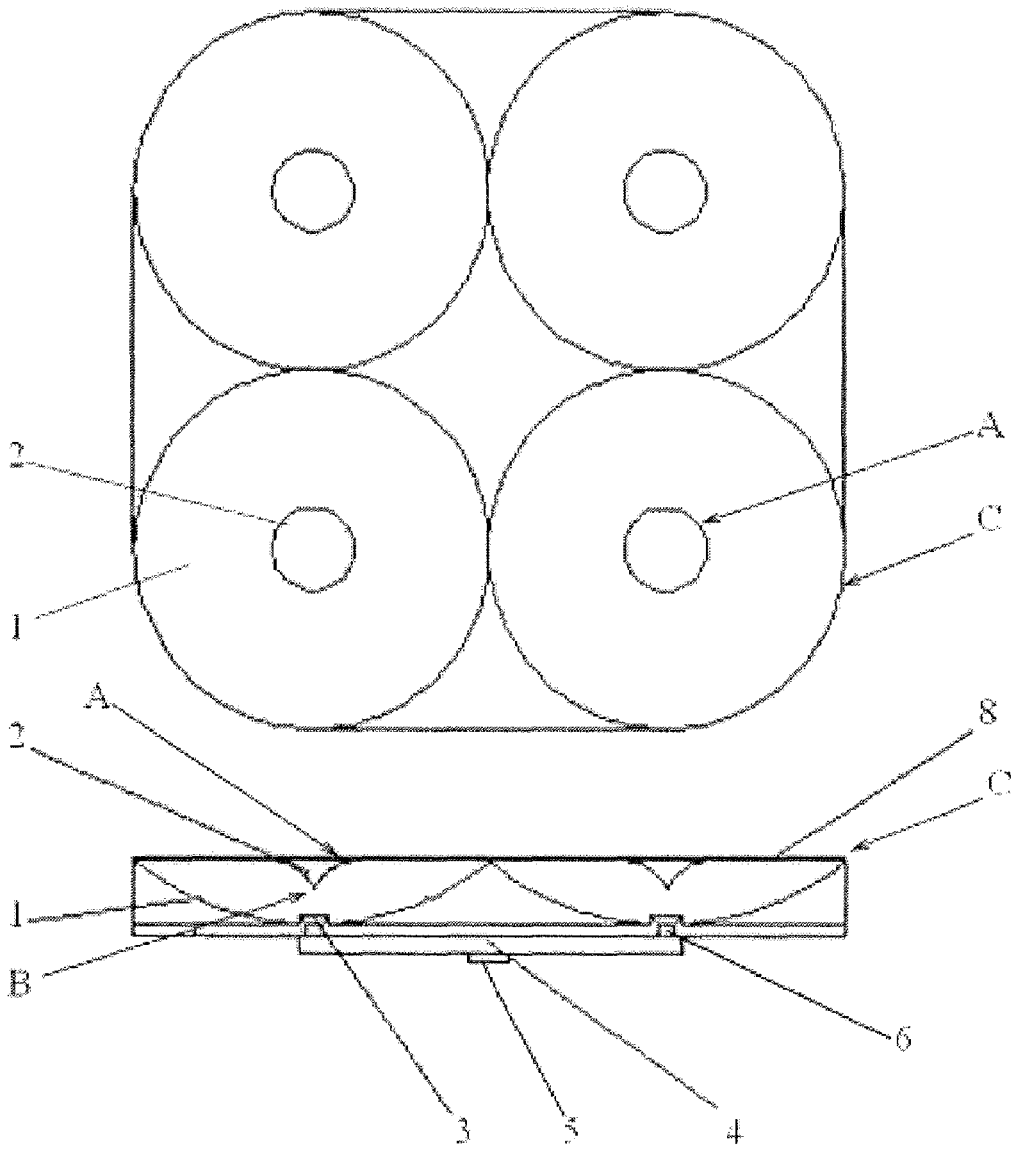
FIG. 1 schematically shows antenna-feeder device (AFD), top view and side view, FIG. 2 schematically shows the components of an antenna—main reflector & sub-reflector antenna, radiator
Figure 2:
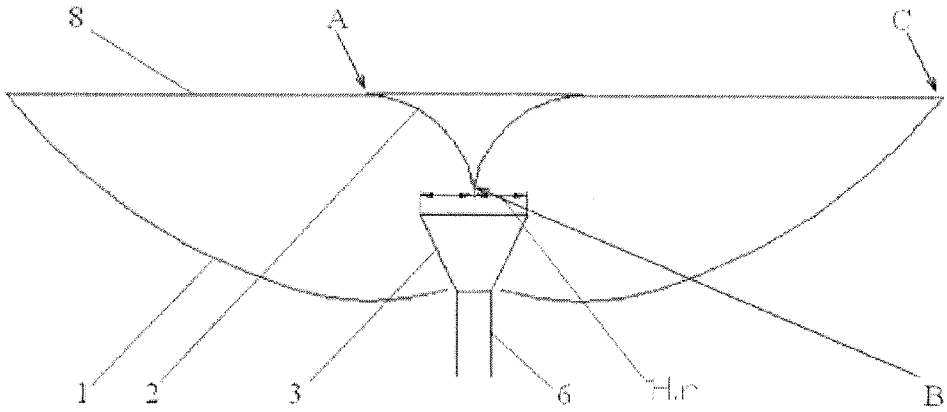

Antenna-feeder device (FIG. 1) comprises four dual reflector antennas situated in one plane and one feeding device. A main reflector 1 of each dual reflector antenna is made with parabolic generatrix and a sub-reflector 2 of each dual reflector antenna is made with elliptic generatrix (FIGS. 1, 2). The sub-reflector 2 has circle A and vertex B. Vertex B is faced to the main reflector 1 and situated between circle A and the main reflector 1. Radiator 3 for each dual reflector antenna is situated on rotation axis (longitudinal symmetry axis Z) in the main reflector 1 base between the main reflector 1 and the sub-reflector 2. Feeding device 4 (FIG. 1) is assigned for connection with input 5 to receiving and/or transmitting device. Four outputs 6 of feeding device 4 are connected to radiators 3 of each dual reflector antenna correspondingly. Feeding device is made of power dividers where each divider is made in form of single mode transmission lines junction and each divider is made co-phased with power division on two equal halves.

Input 5 and four outputs 6 of feeding device 4 (FIG. 3) are made of dual mode transmission line sections. Input 5 is connected through dividers to four outputs 6 by means of single mode transmission line sections. The dividers are situated in one plane. Two side branches of each divider are connected to neighboring outputs 6 correspondingly and central branches of four dividers are connected from four sides to input 5 of feeding device 4. Phase shifters 7 providing 180 degrees phase shift for two outputs 6 situated on opposite sides relatively input 5 are embedded. Circle A of the sub-reflector 2 (its periphery) is situated in the plane of the main reflector 1 edge circle C formed by parabolic surface (FIGS. 1, 2).

Cover 8 (FIG. 1) is situated in the plane of the main reflector 1 edge circle C, common for each of antennas can be embedded in AFD. Circle A of the sub-reflector 2 is fixed on cover 8.

In order to provide dual mode transmitting technology, input 5 and four outputs 6 of feeding device 4 may be done of circular waveguide sections (FIGS. 3-5) or input 5 and for outputs 6 of feeding device 4 may be done of square waveguide sections (not shown on Figure).

Figure 4:
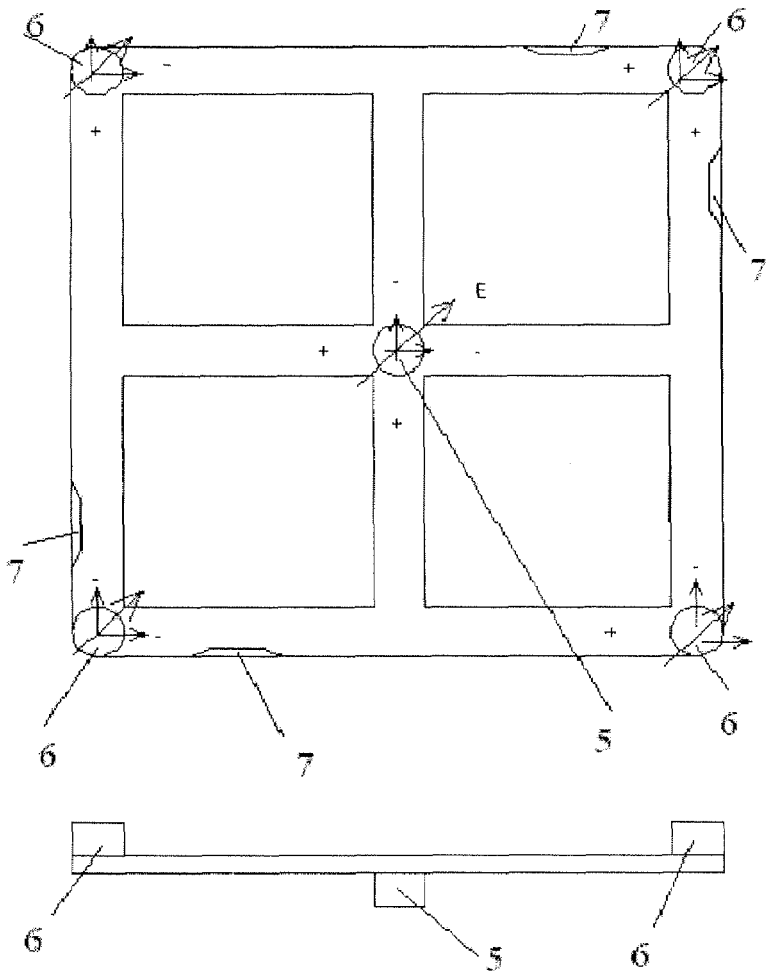
FIG. 4 shows diagram consists of waveguides.
Figure 5:
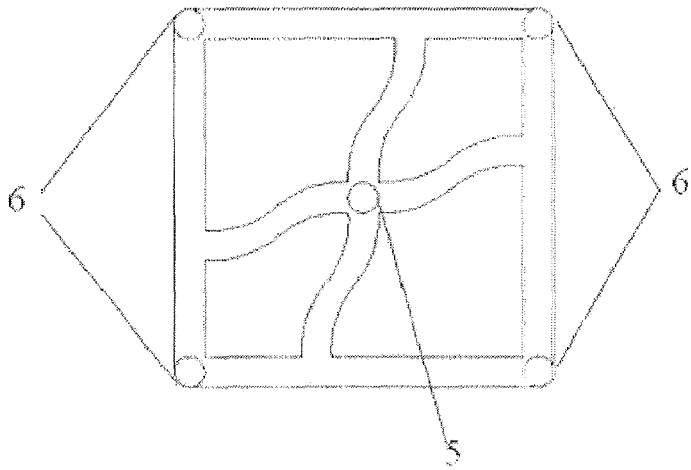
FIG. 5 shows diagram where phase shifters are realized by length increasing of side branches of T-shaped junction.

Input 5 may be connected to four outputs 6 by means of rectangular waveguide sections (FIGS. 4, 5). In this case dividers are made of T-shaped connectors.

Phase shifters 7 may be done by decreasing of rectangular waveguides width in side branches of T-shaped junctions faced to corresponding output (FIG. 4) or phase shifters 7 may be done by dielectric plates embedded into side branches of T-shaped junctions faced to corresponding output. Phase shifters 7 may be done by increasing lengths of side branches of T-shaped junctions faced to corresponding output (FIG. 5).

Figure 3:
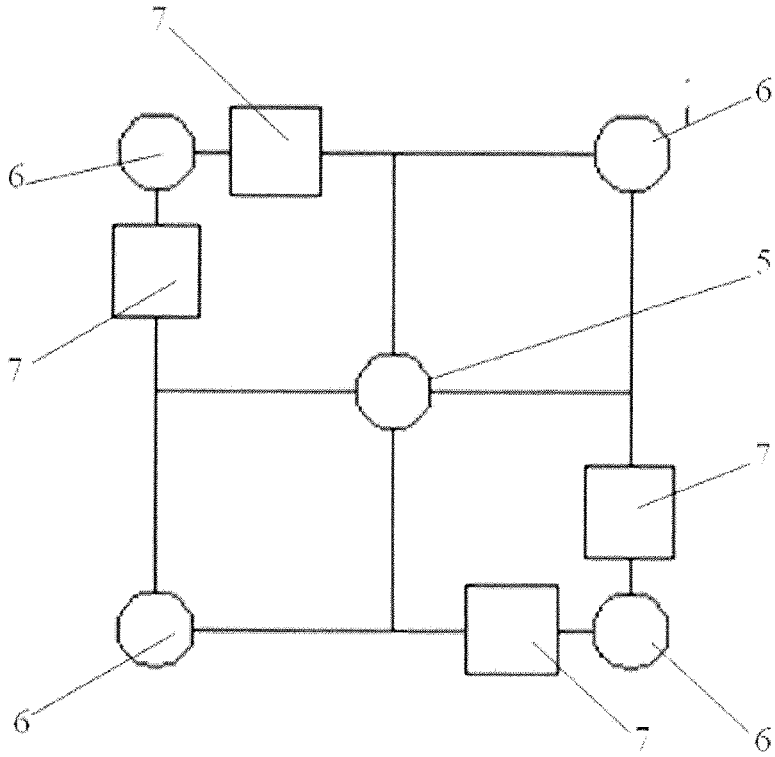
FIG. 3 shows functional diagram of feeding device.

Input 5 may be connected to four outputs 6 by means of coaxial line sections (FIG. 3). In this case, dividers may be done in form of coaxial T-shaped junctions. Phase shifters 7 may be done by lengths increasing of T-shaped junctions branches faced to corresponding output (similarly to FIG. 5).

Input 5 (FIGS. 3, 6) may be connected to four outputs 6 by means of strip line sections. Symmetrical strip lines may be done. Phase shifters 7 may be done in shape of loops.

Figure 6:
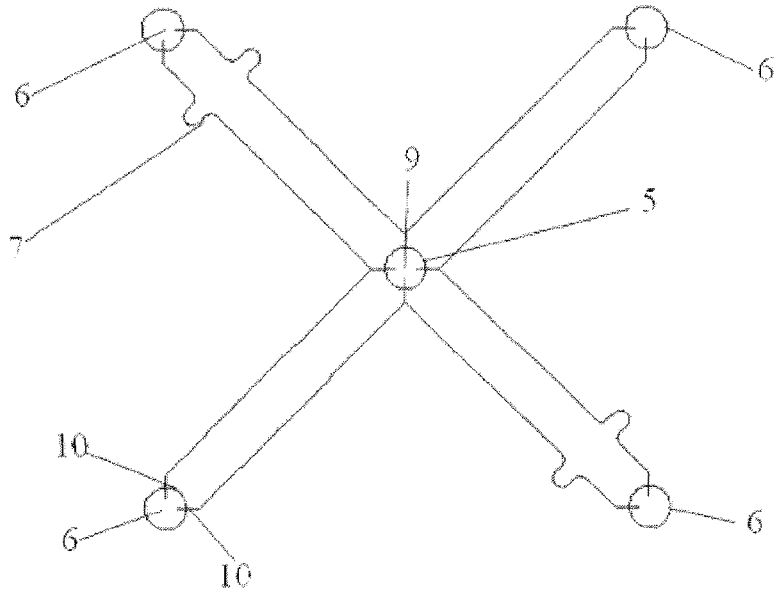
FIG. 6 shows diagram where dividers comprise strip lines.

In order to simplify design, in particular, side divider branches are made of strip lines and central divider branch is made as a probe 9 (FIG. 6). One end of probe 9 is connected to corresponding strip line and the other end of probe 9 is embedded inside output 5-section of dual mode transmission line. Side divider branches are embedded inside corresponding output sections of dual mode transmission line by means of probes 10.

For instance, the first antenna (FIGS. 2, 7) comprises a main reflector 1 made with parabolic generatrix and a sub-reflector 2 made with elliptic generatrix. The sub-reflector 2 has circle A and vertex B, the Vertex B being faced to the main reflector 1 and being situated between circle A and the main reflector 1; Radiator 3 being located on longitudinal symmetry axis Z in the main reflector 1 base between the parabolic surface of main reflector 1 and the sub-reflector 2.

Figure 7:
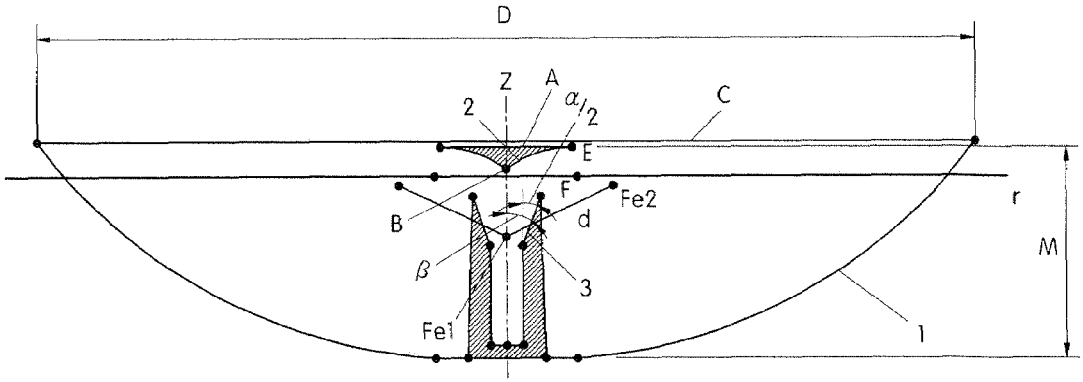
FIG. 7 shows an geometry of an antenna.

Circle A of the sub-reflector 2 (FIGS. 2, 7) may be located on the highest point (Z coordinate of plus direction) of the sub-reflector 2 as in the FIG. 7 horizontally to r axis of FIG. 7, and Circle A of the sub-reflector 2 (FIGS. 2, 7) may be also located over the highest point (+Z coordinate of plus direction) of the sub-reflector 2 as in the FIG. 7 horizontally to r axis of FIG. 7 when the stable manufacturing during mass production considered for the thickness of sub-reflector 2.

The sub-reflector 2 works best when it is the body of revolution of elliptic shape which axis coincides with axis of the revolution (Z axis, longitudinal symmetrical center of whole antenna).

However, the sub-reflector 2 of the body of revolution of elliptic shape which axis is placed in the proximity of Z axis, away from Z axis (Axis of revolution), can be useful. In this case, Vertex B may not be located on the axis of revolution (Z axis) but away from the axis of revolution, and in this manner, Vertex B may be shaped, and defined even terminologically here, as many arbitrary geometrical solid figures, not being expressed or defined only as the term of "a sharp point".

The sub-reflector 2 may be made with elliptic generatrix with eccentricity Exc, ranging from 0.55 to 0.75.

Further, the ratio of the distance M between the sub-reflector circle A and the main reflector apex to the main reflector diameter D ranges 0.15~0.35 (refer to FIG. 7)

The above value 0.15~0.35 mentioned in all modifications of the present invention corresponds to the value such as F/D ratio 0.65 etc concerning the traditional reflector antenna and it represents "lower profile" the idea and usefulness of this invention.

Circle A of the sub-reflector 2 (FIGS. 2, 7) may be situated in one plane or near the plane of the edge Circle C of the main reflector 1.

Cover 8 situated in the near region or the same plane of the edge Circle C of the main reflector 1 may be embedded in the above antenna and Circle A of the sub-reflector 2 may be fixed on cover 8.

Figure 10:
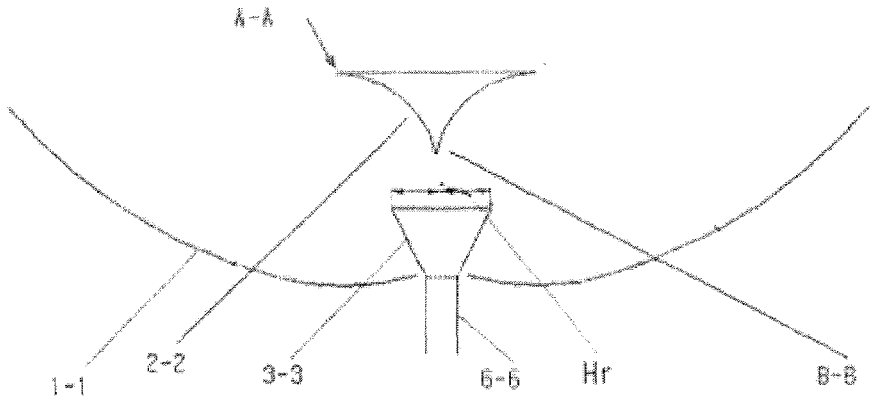
FIG. 10 shows antenna comprising arbitrary curves of main reflector and sub-reflector.
Figure 11:
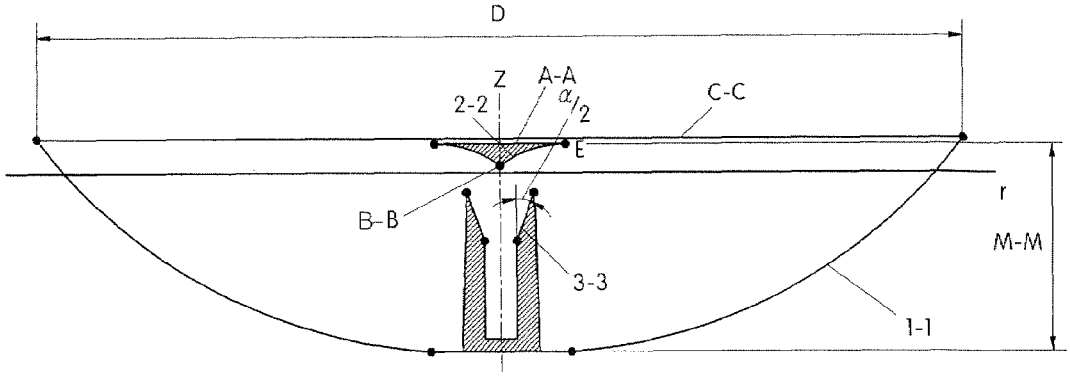
FIG. 11 shows an geometry of an antenna comprising arbitrary curves of main reflector and sub-reflector.

Further, the second antenna (FIGS. 10, 11) comprises a main reflector 1-1 being a body of revolution of arbitrary curve which axis diverges from axis of the revolution; a sub-reflector 2-2 being a body of the revolution of arbitrary curve along the axis of revolution, having a Circle A-A and a vertex B-B pointing to the main reflector 1-1 and being placed between the Circle A-A and the main reflector 1-1; a radiator 3-3 being located along the axis of revolution of the main reflector 1-1 and being placed between the main reflector 1-1 and the sub-reflector 2-2; and wherein the ratio of the distance M-M between the sub-reflector 2-2 Circle A-A and the main reflector 1-1 apex to the main reflector 1-1 diameter D ranges 0.15~0.35(Refer to FIG. 11)

The above value 0.15~0.35 mentioned in all modifications of the present invention corresponds to the value such as F/D ratio 0.65 etc concerning the traditional reflector antenna and it represents "lower profile" the idea and usefulness of this invention.

Further, the main reflector 1-1 and the sub-reflector 2-2 may be defined as follows:

$$z_m(r, D) = \sum_{n=0}^{4}\sum_{m=0}^{6} qm_{n,m} D^{m-n+1} r^n,$$

$$z_s(r, D) = \sum_{n=0}^{4}\sum_{m=0}^{6} qs_{n,m} D^{m-n+1} r^n,$$

z,r are coordinates of the main reflector and the sub-reflector measured in millimeters, Index m corresponds to the main reflector, index s to the sub-reflector D is the main reflector diameter measured in millimeters.

and numbers $qm_{n,m}$ and $qs_{n,m}$ may be selected in the ranges:

$$qm0_{n,m} - \frac{3}{D^{m+1}} \le qm_{n,m} \le qm0_{n,m} + \frac{3}{D^{m+1}},$$

$$qs0_{n,m} - \frac{1.5}{D^{m+1}} 40^n \le qs_{n,m} \le qs0_{n,m} + \frac{1.5}{D^{m+1}} 40^n,$$

where $qs0_{n,m}$, $qm0_{n,m}$ are defined in the below tables:

TABLE 1

| | m = 0 | 1 | 2 | 3 | 4 | 5 | 6 |
|---|---|---|---|---|---|---|---|
| $qs0_{n,m}$ | | | | | | | |
| n = 0 | 0.40362 | −0.00422 | 1.87E−05 | −4.3E−08 | 5.47E−11 | −3.6E−14 | 9.57E−18 |
| 1 | −7.98145 | 0.098642 | −0.00044 | 1.02E−06 | −1.3E−09 | 8.36E−13 | −2.2E−16 |
| 2 | −325.922 | 3.60874 | −0.01599 | 3.54E−05 | −4.2E−08 | 2.44E−11 | −5.6E−15 |
| 3 | 2687.903 | −27.1192 | 0.101879 | −0.00017 | 1.02E−07 | 2.11E−11 | −3.2E−14 |
| 4 | 4992.915 | −116.572 | 0.882748 | −0.00311 | 5.53E−06 | −4.8E−09 | 1.65E−12 |
| $qm0_{n,m}$ | | | | | | | |
| n = 0 | −1.67048 | 0.017508 | −7.9E−05 | 1.77E−07 | −2.1E−10 | 1.34E−13 | −3.4E−17 |
| 1 | 1.882187 | −0.03057 | 0.000154 | −3.8E−07 | 4.91E−10 | −3.3E−13 | 8.85E−17 |
| 2 | −9.07096 | 0.118857 | −0.00053 | 1.18E−06 | −1.4E−09 | 9.02E−13 | −2.3E−16 |
| 3 | 0 | 0 | 0 | 0 | 0 | 0 | 0 |
| 4 | 0 | 0 | 0 | 0 | 0 | 0 | 0 |

Further, the main reflector 1-1 may be a body of revolution of arbitrary curve which axis coincides with axis of the revolution The sub-reflector 2-2 works best (optimal) when it is the body of revolution of arbitrary curve which axis coincides with axis of the revolution.

However, the sub-reflector 2-2 of the body of revolution of arbitrary curve who's axis is placed in the proximity of Z axis, away from Z axis (Axis of revolution, symmetrical center of antenna), can be also useful. In this case, Vertex B-B is not placed on the axis of revolution but away from the axis of revolution, and in this manner, Vertex B-B may be shaped, and defined even terminologically here, as many arbitrary geometrical solid figures, not being expressed or defined only as the term of "a sharp point".

Circle A-A of the sub-reflector 2-2 (FIGS. 10, 11) may be located on the highest point (Z coordinate of plus direction) of the sub-reflector 2-2 as in the FIG. 11 horizontally to r axis of FIG. 11, and Circle A-A of the sub-reflector 2-2 (FIGS. 10, 11) may be also located over the highest point (+Z coordinate of plus direction) of the sub-reflector 2-2 as in the FIG. 11 horizontally to r axis of FIG. 11 when the stable manufacturing during mass production considered for the thickness of sub-reflector 2-2

It is notable that while the description and the claims utilize to the geometrical form, engineering considerations may dictate deviation from this ideal shape, yet allow a functionally equivalent shape to perform in accordance with the mode of operation and the functions described herein, and thus the invention and the claims should be construed to extend to such embodiments.

For example, non parabolic shaped curve of main reflector and non elliptic shaped curve of sub-reflector may be produced by the machine of mass production even though they are intended for parabolic and elliptical curve separately according to some of modifications of the present inventions.

Thus, the invention and the claims should be construed to extend to such embodiments which deviate within at least +λ/8 to −λ/8 or +λ/16 to −λ/16 of the curve coordinates of main reflector and sub-reflector defined in this invention It is notable that the antenna having the tolerance more than the ranges +λ/8 to −λ/8 or +λ/16 to −λ16 of the curve coordinates defined in this invention, may be useful in the industrial field and thus the invention and the claims should be construed to extent to such embodiments.

Antenna-feeder device (FIG. 1) works in the following way.

The function executed by feeding device is equi-amplitude and co-phased excitation of dual mode transmission line sections of outputs 6 with the same orientation of electric field vector E as in dual mode transmission line section of input 5 (FIGS. 3, 4). Let input 5 be excited by wave with electric field vector oriented along one of square diagonals which peaks lie on axes of output dual mode waveguides (outputs 6) as shown on FIG. 4. This electric field vector can be decomposed into two components: vertical and horizontal. Then vertical component will excite upper and lower T-shaped junctions and horizontal component will excite right and left T-shaped junctions. Let waves in left and down T-shaped junctions have conditional 0 degrees phase then waves in upper and right T-shaped junctions have 180 degrees phases. Wave with 0 degrees phase is labeled on FIG. 4 by sign "plus" and antiphased wave with 180 degrees phase is labeled by sign "minus".

Waves excited by input 5 are divided in halves by power dividers and come through side arms to outputs 6 of dual mode transmission lines sections. Because of the fact that path length in which waves pass from input 5 to outputs 6 are equal then in the absence of phase shifters 7 the waves would come to outputs 6 with same phases as were provided during their excitation. However, due to phase shifters 7 180 degrees, phase shifted phases of waves exciting outputs will be distributed in the way as shown on FIG. 4.

Note that vertical rectangular waveguides excite vertical component of vector E in circular waveguides and horizontal rectangular waveguides excite horizontal component of vector E in circular waveguides. Phase of excited component is determined by phase of wave in rectangular waveguide connected to output 6 (circular or square waveguide 2) and Phase of excited component is determined by orientation of exciting rectangular waveguide relatively placed (positioned) output waveguide of output 6 and by phase of wave in rectangular waveguide.

Vertical component is excited with 0 degrees phase if exciting wave has 0 degrees phase and rectangular waveguide is connected to output from below. Similarly, vertical component of field will have 0 degree phase if rectangular waveguide is connected to output from above and if exciting wave has 180 degrees phase. In a similar way, vertical component will have 0 degree phase if it is excited from the left side and if wave has 0 degrees phase, and vertical component will also have 0 degree phase if it is excited from the right side and if wave has 180 degrees phase. FIG. 4 shows that at all outputs 6 vertical and horizontal components are excited with 0 degrees phase and thus integrated vector of electrical field is oriented exactly as at input 5. Work of feeding device 4, when being excited by wave with orthogonally oriented electrical field vector E, can be described in a similar way.

Circular or square waveguides which is able to support transmission of two main orthogonally polarized waves (wave modes) are used as input and output waveguides. T-shaped junctions are formed by rectangular waveguides connected in H-plane. Specific connection configuration can comprise additional elements providing matching of central branch of junction. Such elements are pins, matching wedges etc. In the same way connection between rectangular and circular waveguides may comprise additional elements providing its proper work. Choice of structure and parameters of additional elements is a problem of engineering design and may be solved by known means, for instance, using systems of electrodynamic simulation, such as High Frequency Structure Simulator (HFSS) providing high accuracy in prediction of high frequency waveguide devices parameters. It is clear to specialists that choice of structure and parameters of additional elements is not the subject of present invention that can comprise different technical improvements known from modern technology level.

In connection shown on FIG. 4, phase shifters 7 are made as rectangular waveguide sections with changed width. It is known that propagation constant of main wave $\gamma$ in rectangular waveguide depends on its width $\alpha$ in the following way $$\gamma = \sqrt{k^2 - \left(\frac{\pi}{a}\right)^2}$$

where k is free space wave number. From the formula shown above, it follows that changing waveguide width one can change its propagation constant and therefore phase shift in waveguide section that is equal to multiplication of propagation constant and section length.

Phase shifter 7 may also be realized by embedding of changing propagation constant dielectric plates into waveguide.

FIG. 5 shows waveguide connection with phase shift produced by moving of waveguide connection point. The same connection can be used for coaxial transmission lines.

Displacement of T-shaped connection middle point relatively in middle of waveguide section connecting neighboring outputs is 0.25 of wavelength in transmission line. In this case phase difference of waves in side branches of T-shaped junction reaches required 180 degrees.

Strip lines can be used in connector instead of waveguides. The simplest for this case is symmetrical strip line (or just strip line) that is formed by strip line conductor placed between two metal screens. In this connection base of antenna can represent one of screens. Strip conductors are made on thin dielectric films by means of printed circuits technology. Film including element of printed circuit is placed between two foam plates which in their turn are placed between two metal plates mentioned above. This configuration forms a symmetrical strip line filled with dielectric which parameters are close to air parameter because dielectric properties of foam are similar to dielectric properties of air. It is a very important factor at high frequencies because it allows one to exclude dielectric losses, typically for dielectrics with higher dielectric permittivity.

FIG. 6 schematically shows strip line conductors topology providing work of feeding device 4. Coupling between strip line and circular waveguides is provided by probes 9, 10 embedded into waveguides. Design of probes 9, 10 is made as continuation of strip lines. Phase shifters 7 represent additional strip line sections made in shape of loops. The length of loop provides 180 degrees phase shift between loop and straight transmission line.

As a result (FIGS. 3-6), signals come to radiators 3 of each of four antennas (FIG. 1) from four outputs 6 maintaining transmission of two signals with orthogonal polarizations. Radiator 3 (FIG. 2) can be made as a conical horn, pyramidal horn with square cross-section, conical or pyramidal corrugated horn etc.

The sub-reflector 2 (FIG. 2) represents a body of revolution formed by ellipse rotation along the axis coinciding with antenna (FIG. 7) body axis (longitudinal axis of symmetry Z). FIG. 7 shows: Fe1—first focus of the sub-reflector 2 ellipse, F2—second focus of the sub-reflector 2, F—focus of the main reflector 1 parabola, H—edge of exiting horn 3, E—edge of the sub-reflector 2.

The main reflector 1 may be formed as a body of revolution received by parabola rotation around antenna axis of symmetry Z. Apex of parabola may be also situated on rotation axis Z. When ellipse is rotated, one of its focuses Fe1 (first focus) is situated on rotation axis Z and the second focus Fe2 is removed from this axis Z and creates focal ring of diameter De (with radius $Fe2_r$) when ellipse is rotated. Similarly, when parabola is rotated, its focus creates focal ring with diameter Dp (with radius Fr).

The sub-reflector 2-2 (FIG. 10) represents a body of revolution formed by arbitrary curve rotation along the axis coinciding with antenna (FIG. 11) body axis (longitudinal axis of symmetry Z). The main reflector 1-1 may be formed as a body of revolution received by arbitrary curve rotation around antenna axis of symmetry Z. Apex of the arbitrary curve of main reflector 1-1 may be also situated on rotation axis Z.

Due to reprocity of antenna-feeder device, antenna operation may be considered both in receiving mode and in transmission mode. Let us consider antenna operation in wave transmission mode. One of two orthogonally polarized waves comes to input of horn of radiator 3. This wave excites spherical wave in horn 3, 3-3, which phase center coincides in horn 3 cases with apex of conical or pyramidal surface of horn 3. Spherical wave propagates along radiator horn 3,3-3 up to it's upper edge H (FIG. 7) (FIG. 11), where it transforms into spherical wave of free space with pattern determined by radiator horn 3, 3-3 length and flare angle.

Spherical wave of free space irradiates a sub-reflector 2, 2-2. In order to decrease power losses in antenna and increase antenna efficiency, horn 3,3-3 pattern is taken in such shape that, from the first side, it provides energy non-overflowing outwards of the sub-reflector 2, 2-2 and from the other side, it provides uniform "illuminating" of the sub-reflector 2, 2-2. The shape of the sub-reflector 2, 2-2 made from metal reflects incident waves in direction of the main reflector 1, 1-1. In it's turn, the main reflector 1, 1-1 re-radiates incident waves to the free space.

In order to provide the above mentioned propagation and reflection of waves, one should solve a problem of choice of parameters of main reflector and sub-reflector. As a example, Solution of these problems by means of geometrical optics brings to the situation that first focus Fe1 of elliptical surface coincides with phase center of radiator 3 (open end of waveguide) and it's second focus Fe2 coincides with parabola focus F. Thus, focal rings received as a result of parabola and ellipse rotation, coincide. Such geometry is typical for design of antennas with big electrical size, i.e. antenna size is more than 36 wavelength. In such arrangement of focal points in aperture of the main reflector 1, in-phase distribution of field is provided which is equivalent of parallel beam forming which creates radiation in far zone further comprising narrow beam pattern. After passing near-focal zone, the beam expands and "illuminates" surface of the main reflector 1 which reflects incident waves and thus forms a field of antenna radiation.

The special feature of an antenna with minimal thickness is that the thickness of this antenna and the size of the sub-reflector 2, 2-2 are comparable with wavelength in free space. As an example, the situation that diameter of Circle A (FIG. 2), diameter of the sub-reflector 2 (FIG. 7) is about 1.5-2 wavelengths, is preferable. For frequently used sizes of main reflectors 1 and sub-reflectors 2, geometrical optics do not give adequate description of antenna operating principles and can not be used in order to make right choice of the main reflector and the sub-reflector parameters.

In case of antenna with minimal thickness (and maximal aperture efficiency), the above shown arrangements for focus disposing are not satisfactory at least to antennas characteristic of diameter D of a main reflector of the range of 1 to 36 wavelengths. Evidently, the use of sub-reflectors 2 with big electric sizes will lead to aperture efficiency decreasing due to shadowing of the main reflector 1 by the sub-reflector 2. Thus, as an example, maximal efficiency values will be reached when diameter A of sub-reflector 2 is 2-3 wavelengths. It can be noted, as one example, that when diameter of a main reflector 1 is changing in range of 5-18 wavelengths, the antenna thickness is changing in range of 1-3.5 wavelengths. Under 1-3.5 wavelength sizes of radiator 3 and sub-reflector 2, their focuses are diffused and therefore wave beam incident to the main reflector 1 can not be described correctly in terms of geometrical optics. It is evidently noted that the above explanation can be applied to the main reflector 1-1 and the sub-reflector 2-2.

A correct approach to antenna parameters synthesis is electrodynamical approach based on formulation and solution of boundary value problem for Maxwell equations in combination with algorithms of parametric optimization. Within the frames of such approach, targeted functions are formulated, such as, for instance, aperture efficiency, antenna thickness, sidelobe level and so on. Also a set of free parameters is formulated as characteristic points coordinates or their position, describing size and shape of a main reflector 1, 1-1 a sub-reflector 2, 2-2 and a horn of radiator 3, 3-3. Changing free parameters, one can find a set of parameters providing minimum (or maximum) of goal function (functions). This set of parameters is optimal.

The choice of a main reflector 1,1-1 a sub-reflector 2,2-2 and a radiator 3,3-3 characteristic points coordinates has been done with consideration of wave structure of electromagnetic field and diffraction effects existence on edges of the main reflector 1, 1-1 the sub-reflector 2,2-2 and radiator 3,3-3. Numerical calculations and antenna parameters optimization made by a computer program for solving of electrodynamic boundary value problem and also experimental results show that as an example, for all types of antenna, a sub-reflector 2 could be made on a base of elliptical surface of eccentricity parameter Exc. values in range from 0.55 to 0.75.

In this case, Circle A of the sub-reflector 2 can be placed in the plane of Circle C formed by the main reflector 1 edge. In its turn, this condition provides minimization of antenna longitudinal size and also makes possible to install the sub-reflector 2 on cover 8 because upper edges of the sub-reflector 2 and the main reflector 1 edge Circle C are positioned on one level. Fixation of the sub-reflector 2 on cover (FIGS. 1, 2) gives certain advantages because there is no need to fix the sub-reflector 2 on special dielectric supports attached to horn 3 like in a conventional way.

Figure 8:
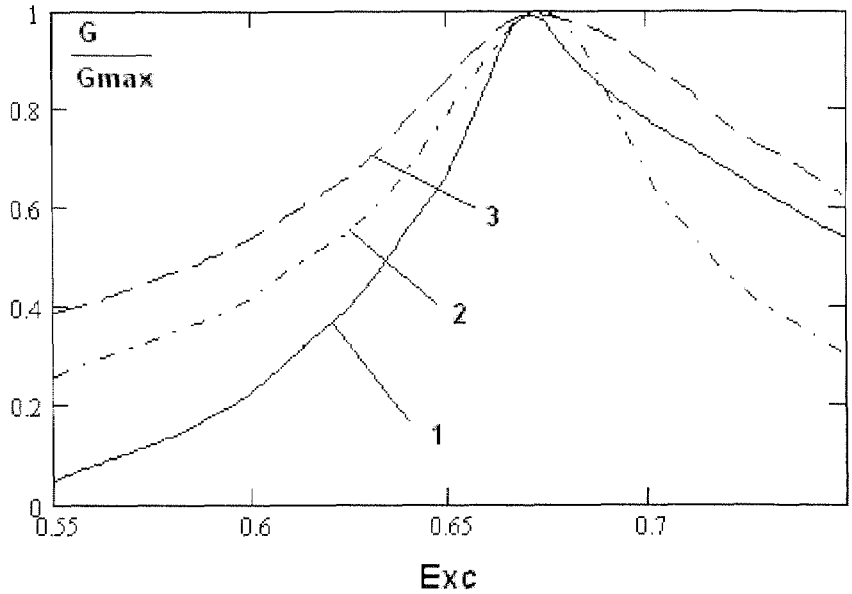
FIG. 8 shows antenna aperture efficiency (normalized to maximal aperture efficiency) dependence on the sub-reflector eccentricity for the main reflector diameters of different antennas.

FIG. 8 shows aperture efficiency decreasing when eccentricity falls outside the optimal limits shown above. FIG. 8 shows that aperture efficiency substantially depends on eccentricity for all antennas with different main reflector 1 diameters D.

First focus of ellipse Fe1 and phase center of exciter 3 horn like in conventional antennas are disposed on antenna symmetry axis Z coinciding with parabola and ellipse rotation axis. However, for maximal aperture efficiency achievement, first ellipse focus Fe1 can be slightly dislodged in relation to horn phase center along Z axis in positive direction from the main reflector 1.

Because of antenna axial symmetry, antenna's excitation by waves of two orthogonal polarization takes part in the same way because the difference between these waves is only 90-degrees polarization vector turn relatively antenna axis.

The results of optimization are shown in table 2. Coordinates of characteristic points in coordinate system r,z for different values of main reflector 1 diameter D are shown below.

Figure 9:
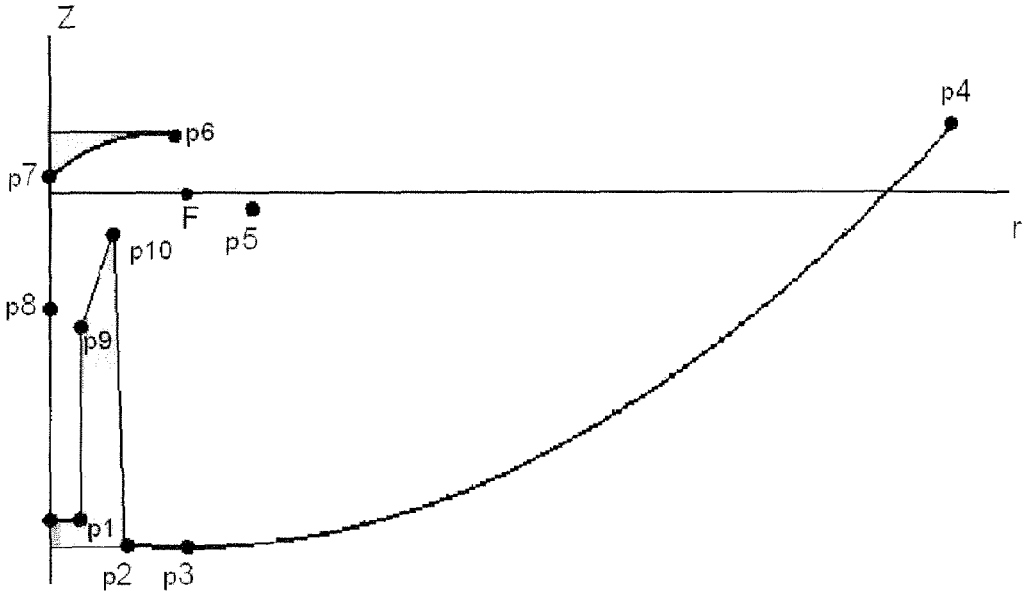
FIG. 9 shows all the coordinates specifying an antenna according to each antenna size in relation with Table 2

The r coordinate of Focus of main reflector 1 is same with p3 r coordinate in FIG. 9

All antennas were optimized for frequency range with central frequency 12.2 GHz in the below table in relation with FIG. 9.

TABLE 2

| D | foc | r1 | z1 | r2 | z2 | exc | r3 | z3 | z4 |
|---|---|---|---|---|---|---|---|---|---|
| 900 | 198 | 8.452 | −190.6 | 16.2 | −197.4 | 0.6757 | 35.7 | −197.9 | 18.36 |
| 600 | 123.2 | 8.4 | −115.9 | 18.1 | −122.6 | 0.6733 | 35.7 | −123.2 | 18.0 |
| 400 | 71.67 | 8.452 | −64.31 | 17 | −70.3 | 0.6733 | 37.99 | −71.67 | 20 |
| 292 | 56.11 | 8.452 | −84.23 | 17.2 | −56.1 | 0.6669 | 21.37 | −56.11 | 13.2 |
| 172 | 23.59 | 8.452 | −51.71 | 18.8 | −23 | 0.6669 | 26.67 | −23.59 | 13.7 |
| 112 | 9.501 | 8.452 | −37.62 | 23.2 | −9 | 0.6723 | 27.83 | −9.501 | 11.4 |

| D | r5 | z5 | r6 | z6 | z7 | z8 | z9 | r10 | z10 |
|---|---|---|---|---|---|---|---|---|---|

TABLE 2-continued

| | | | | | | | | | |
|---|---|---|---|---|---|---|---|---|---|
| 900 | 37.6 | 0.608 | 38.91 | 13.33 | 5.05 | −25.6 | −43.6 | 17.9 | −10.8 |
| 600 | 39.5 | 0.49 | 39.24 | 14.54 | 5.57 | −24.4 | −43.4 | 18.0 | −9.96 |
| 400 | 39.88 | 0.2724 | 41.54 | 13.59 | 4.9 | −25.15 | −34.84 | 17.46 | −10.1 |
| 292 | 27.46 | −0.6574 | 28.71 | 8.619 | 3.4 | −16.23 | −49.3 | 18.42 | −9.337 |
| 172 | 34.21 | −0.494 | 18.2 | 13.6 | 5.2 | −17.17 | −22.04 | 21.78 | −10.04 |
| 112 | 34.82 | −0.5809 | 14.64 | 12.38 | 4.4 | −18.89 | −24.3 | 23.57 | −11.61 |

The most successfully claimed antenna-feeder device and antenna included in this device may be used industrially as a satellite antenna.

It should also be noted that the invention is not limited to use with any band or groups of bands. That is, other antenna application, such as those designed for use at Ku band and Ka band, as well as X band and C band etc, may also benefit from the present invention.

Therefore, while the invention has been described with reference to preferred embodiments, it is to be clearly understood that various substitutions, modifications, and variations may be made by those skilled in the art without departing from the spirit or scope of the invention. Consequently, all such modifications and variations are included within the scope of the invention as defined by the following claims.

We claim:

1. An antenna comprising:

a main reflector being a body of revolution of an arbitrary curve and having an apex;

a sub-reflector being a body of revolution of an arbitrary curve, having a circle and a vertex pointing to the main reflector, being placed between the circle and the main reflector; and a radiator being located along an axis of the revolutions, being placed between the main reflector and the sub-reflector, wherein the ratio of the distance between the circle of the sub-reflector and the apex of the main reflector to the diameter of the main reflector ranges 0.15~0.35 and the main reflector and the sub-reflector are defined as below:

$$z_m(r, D) = \sum_{n=0}^{4}\sum_{m=0}^{6} qm_{n,m} D^{m-n+1} r^n,$$

$$z_s(r, D) = \sum_{n=0}^{4}\sum_{m=0}^{6} qs_{n,m} D^{m-n+1} r^n,$$

wherein, z, r are coordinates of the main reflector and the sub-reflector measured in millimeters, Index m corresponds to the main reflector, and index s to the sub-reflector D is the main reflector diameter measured in millimeters, and numbers $qm_{n,m}$ and $qs_{n,m}$ is selected in the ranges as the below:

$$qm0_{n,m} - \frac{3}{D^{m+1}} \le qm_{n,m} \le qm0_{n,m} + \frac{3}{D^{m+1}},$$

$$qs0_{n,m} - \frac{1.5}{D^{m+1}} 40^n \le qs_{n,m} \le qs0_{n,m} + \frac{1.5}{D^{m+1}} 40^n,$$

where $qs0_{n,m}$, $qm0_{n,m}$ are defined in the below tables:

| $qs0_{n,m}$ | m = 0 | 1 | 2 | 3 |
|---|---|---|---|---|
| n = 0 | 0.40362 | −0.00422 | 1.87E−05 | −4.3E−08 |
| 1 | −7.98145 | 0.098642 | −0.00044 | 1.02E−06 |
| 2 | −325.922 | 3.60874 | −0.01599 | 3.54E−05 |
| 3 | 2687.903 | −27.1192 | 0.101879 | −0.00017 |
| 4 | 4992.915 | −116.572 | 0.882748 | −0.00311 |

| $qS0_{n,m}$ | 4 | 5 | 6 |
|---|---|---|---|
| n = 0 | 5.47E−11 | −3.6E−14 | 9.57E−18 |
| 1 | −1.3E−09 | 8.36E−13 | −2.2E−16 |
| 2 | −4.2E−08 | 2.44E−11 | −5.6E−15 |
| 3 | 1.02E−07 | 2.11E−11 | −3.2E−14 |
| 4 | 5.53E−06 | −4.8E−09 | 1.65E−12 |

| $qm0_{n,m}$ | m = 0 | 1 | 2 | 3 |
|---|---|---|---|---|
| n = 0 | −1.67048 | 0.017508 | −7.9E−05 | 1.77E−07 |
| 1 | 1.882187 | −0.03057 | 0.000154 | −3.8E−07 |
| 2 | −9.07096 | 0.118857 | −0.00053 | 1.18E−06 |
| 3 | 0 | 0 | 0 | 0 |
| 4 | 0 | 0 | 0 | 0 |

| $qm0_{n,m}$ | 4 | 5 | 6 |
|---|---|---|---|
| n = 0 | −2.1E−10 | 1.34E−13 | −3.4E−17 |
| 1 | 4.91E−10 | −3.3E−13 | 8.85E−17 |
| 2 | −1.4E−09 | 9.02E−13 | −2.3E−16 |
| 3 | 0 | 0 | 0 |
| 4 | 0 | 0 | 0. |

2. An antenna comprising:

a main reflector being a body of revolution of an arbitrary curve and having an apex;

a sub-reflector being a body of revolution of an elliptical curve, having a circle and a vertex pointing to the main reflector and, being placed between the circle and the main reflector, and having two focuses, the two focuses being located between the sub-reflector and the main reflector; and a radiator being located along an axis of revolutions, being placed between the main reflector and the sub-reflector;

and wherein the sub-reflector has eccentricity ranging from 0.55 to 0.75, and the ratio of the distance between the circle of the sub-reflector and the apex of the main reflector to the diameter of the main reflector ranges 0.15~0.35.

3. The antenna according to claim 2 wherein a distance d between the two focuses of the sub-reflector is selected under the following condition:

$$\frac{d}{\lambda} = \begin{cases} 1.2 - 1.6 & \text{when } \frac{D}{\lambda} \le 12 \\ 1.8 - 2.1 & \text{when } \frac{D}{\lambda} > 12 \end{cases},$$

wherein

λ is a free space wavelength

D is the diameter of the main reflector.

4. The antenna according to claim 3 wherein an angle β between a line connecting the two focuses of the sub-reflector and the axis of the revolution is selected in the range of 45-70 degrees.

5. The antenna according to claim 2 wherein the circle of the sub-reflector which radius Er is selected under the following condition:

$$\frac{E_r}{\lambda} = \begin{cases} 0.5 - 1.2 & \text{when } \frac{D}{\lambda} \le 12 \\ 1.5 - 1.8 & \text{when } \frac{D}{\lambda} > 12 \end{cases}$$

where λ is a free space wavelength, and D is the diameter of the main reflector.

6. The antenna according to claim 2 wherein the radiator is in the shape of a conical horn, in which the relation between the radius $H_r$ of the conical horn of the radiator and free space wavelength is selected in the following range:

$$0.6 < \frac{H_r}{\lambda} < 1.1.$$

7. The antenna according to claim 6 wherein a flare angle α of the radiator is selected under the following condition:

$$\alpha = \begin{cases} 25 - 60^0 & \text{when } \frac{D}{\lambda} > 8 \\ 70 - 110^0 & \text{when } \frac{D}{\lambda} < 8 \end{cases}.$$

8. The antenna according to claim 2 further comprising a cover situated on or near the plane of an edge circle formed by the main reflector, wherein the sub-reflector is fixed on the cover.

9. An antenna comprising: a main reflector being a body of revolution of a parabolic shape and having an apex; a sub-reflector being a body of revolution of an elliptic shape, having a circle and a vertex pointing to the main reflector, being placed between the circle and the main reflector, and having two focuses including a first focus and a second focus, the two focuses being located between the sub-reflector and the main reflector, the second focus being a focal ring placed away from an axis for the revolution of the elliptic shape; and a radiator being located along an axis of the revolutions between the main reflector and the sub-reflector, wherein the relation between the radius of the focal ring of the sub-reflector second focus and the radius of a focal ring of the main reflector is selected under the following condition:

$$1.015 \leqq Fe2_r/F_r \leqq 1.6$$

wherein the wherein the ratio of the distance between the circle of the sub-reflector and the apex of the main reflector to the diameter of the main reflector-ranges 0.15~0.35 wherein $Fe2_r$ is the focal ring radius of the sub-reflector second focus placed away from the axis, $F_r$ is the focal ring radius of the main reflector.

10. The antenna according to claim 9 wherein the sub-reflector has eccentricity ranging 0.55 to 0.75.

11. The antenna according to claim 9 wherein a distance d between the two focuses of the sub-reflector is selected under the following condition:

$$\frac{d}{\lambda} = \begin{cases} 1.2 - 1.6 & \text{when } \frac{D}{\lambda} \le 12 \\ 1.8 - 2.1 & \text{when } \frac{D}{\lambda} > 12 \end{cases},$$

wherein

λ is a free space wavelength

D is the diameter of the main reflector.

12. The antenna according to claim 9 wherein an angle β between a line connecting the two focuses of the sub-reflector and the axis of the revolution of the elliptical shape is selected in the range of 45-70 degrees.

13. The antenna according to claim 9 wherein the circle of the sub-reflector which radius Er is selected under the following condition:

$$\frac{E_r}{\lambda} = \begin{cases} 0.5 - 1.2 & \text{when } \frac{D}{\lambda} \le 12 \\ 1.5 - 1.8 & \text{when } \frac{D}{\lambda} > 12 \end{cases}$$

where λ is a free space wavelength, and D is the diameter of the main reflector.

14. The antenna according to claim 9 wherein the radiator is in the shape of a conical horn, in which the relation between the radius H, of the conical horn and free space wavelength is selected in the following range:

$$0.6 < \frac{H_r}{\lambda} < 1.1,$$

and a flare angle α of the radiator is selected under the following condition:

$$\alpha = \begin{cases} 25 - 60^0 & \text{when } \frac{D}{\lambda} > 8 \\ 70 - 110^0 & \text{when } \frac{D}{\lambda} < 8 \end{cases}.$$

* * * * *